US005508682A

United States Patent [19]

Wachsman

[11] Patent Number: 5,508,682

[45] **Date of Patent: * Apr. 16, 1996**

[54] SECURITY CLIP DEVICE

[76] Inventor: David R. Wachsman, 17 Ibsen Ct., Dix Hills, N.Y. 11746

[ * ] Notice: The portion of the term of this patent subsequent to Sep. 6, 2011, has been disclaimed.

[21] Appl. No.: 91,980

[22] Filed: Jul. 15, 1993

[51] Int. Cl.[6] ..... G08B 13/14

[52] U.S. Cl. ..... 340/568; 70/59

[58] Field of Search ..... 340/568, 572; 70/58–59

[56] References Cited

U.S. PATENT DOCUMENTS

| | | | |
|---|---|---|---|
| 3,942,829 | 3/1976 | Humble et al. | 70/57.1 |
| 4,616,113 | 10/1986 | Jank et al. | 340/568 X |
| 4,620,182 | 10/1986 | Keifer | 340/568 |
| 5,345,220 | 9/1994 | Wachsman | 340/568 |

FOREIGN PATENT DOCUMENTS

| | | | |
|---|---|---|---|
| 2854434 | 6/1980 | Germany | 340/568 |

*Primary Examiner*—Thomas Mullen

[57] ABSTRACT

An electronic security clip device for use with an electronic security alarm system, mounted on a cable having a switch for providing an alarm signal. The switch, including a probe movable to an alarm position, is positioned in a clamp body with a lower jaw to engage a pivoting upper jaw which are locked so an object between them prevents the probe from sending an alarm. One embodiment of the lock includes a collar for movement to a normally closed position. Preferably the upper jaw and the clamp body each include a plurality of short longitudinally extending ridges of increasing height progressing toward the collar for engagement in the normally closed position. The body also includes a sliding trigger bar movable to a locked position and having a tang for locking the collar in the normally closed position. Another embodiment of the lock includes a locking arm having a cam follower and a cam surface having an upper locus for urging the upper jaw in the normally closed position and a lower locus for movement to an open position. A preferred cam surface includes a plurality of circumferentially extending spherically headed pins of varying heights such that the cam follower snaps into a desired position between pin heads. The cam surface is rotatable from the lower locus to the upper locus in both clockwise and counterclockwise directions. Also included is a lock on the clamp body for locking the cam surface in a desired position of rotation.

22 Claims, 3 Drawing Sheets

SECURITY CLIP DEVICE

FIELD OF THE INVENTION

The present invention relates to a clip for an electronic security system which is particularly adapted for providing protection against shoplifting of merchandise such as garments displayed on garment fixtures or racks. More particularly, the present invention provides fastening device for use with electronic security devices which is of comparatively simplified construction and is characterized by novel features of construction and arrangement providing versatile adaptation to existing furnishings and store fixtures in garment display sections of stores while providing maximum accessibility to individual items of merchandise or apparel displayed on the racks or fixtures.

BACKGROUND OF THE INVENTION

Clothing sales are primarily made by displaying the garments on open racks such that customers may put on the clothing to determine proper fit and may view themselves in the clothing to determine the appropriate aesthetic appeal. However, nicer items such as suits and coats or other outerwear garments have a relatively high value, and concern for security is important. Accordingly, efforts have been made to reduce the likelihood of theft or other unauthorized removal of the garments from the store.

Security devices for garments are, of course, not new per se. A number of systems have been proposed which allow the potential customer to inspect the items in a display rack or fixture without setting off an alarm and, at the same time, preventing the removal of the item from the immediate vicinity of the display. A typical system involves the step of threading a single steel cable through all the garments on a particular rack, such that the ends of the cable are secured by a locking mechanism to the rack. This system has an obvious drawback in that garments are not capable of being put on by the customer, nor are they capable of being purchased until such cable is removed. This is not convenient, even if the desired garment is close to the end of the cable. Particularly with jackets and coats, such a removal and reinsertion process for the steel cable is both time consuming and not conductive to what are called impulse sales.

Attaching an individual cable to each garment is a known way to resolve the difficulties of collective security attachment. It is desirable that a customer be able to select a number of garments from a rack of clothing, try on the several garments, and reach the point of decision to purchase a particular item. One system which has been found to be effective for both security and display of clothing is described in U.S. Pat. No. 4,598,827. This system includes a housing in which a plurality of cables are employed, with each cable being attached at one end to the garment and at the other end to the housing. The attachment to the housing is detachable, such that any one or more individual cables can be removed or attached to the housing without disturbing the other cable attachments.

One method of attaching the cable to the garment is shown in this patent, where a cable is passed through an opening such as a buttonhole in the garment, where the cable has an enlarged plastic button at one end to prevent that end from passing through the opening. The other end of the cable is then attached to the security monitoring housing. The problem with this system, which has been effective up to a point, is that the method for attaching the cable to the goods is awkward and does not include an electronic feature so as to sound an alarm if tampered with. Thus, the cable shown in this patent is not secure against cutting, and would not send an alarm if cut and removed from the garment.

Another system of garment security and protection is shown in U.S. Pat. No. 4,620,182. In this system, an alarm mechanism is employed for signaling a closed circuit condition, such as when the cable which mechanically connects the retail item to the security device is cut. This system has been found to be effective in securing garments which have been displayed on a rack or other store fixture by attaching to the garment as in the prior patent discussed above and to the housing by plugging the other end of the cable into a jack or other electrically connecting fixture. It is intended that the present invention improve this system by a new and improved device for connecting the cable to the object for which security is sought.

In this system, the cable is also sensitive to being cut and will sound an alarm via the disclosed electronic circuitry when, for example, a pair of conductive elements are contained in the cable and complete a circuit when joined together by actions such as cutting of the cable. The system is very effective in some situations, but concern for attachment of the cable to the goods still exists. There is no provision for an alarm to be sounded when the cable is removed from the object, since that attachment is not, in fact, electronically sensitive.

None of the prior art systems provide for complete security, particularly for the attachment of the cable to the object of interest. This has been found to be a major point where the security system is likely to fail, either from inattentive or careless use by the sales personnel. It is also important that the overall security not be disturbed each time one garment is removed from the system, such as when one garment has been sold.

In co-pending, commonly owned patent application filed on Jun. 12, 1992, and having Ser. No. 07/897,707, now U.S. Pat. No. 5,345,220, an improved security system is disclosed in which the individual garments are attached to a security system by individual clip devices attached to the ends of security cables. The other end of the cable is attached to a security/alarm system for recognizing when a garment or other piece of merchandise is taken without authorization by the clerk responsible for the goods. In that pending application, one form of security clip device is disclosed which operates using a spring or other biasing means for keeping the jaws of the clip in a closed position. That clip device is admirably suited for its purposes, as the switch sounds an alarm as soon as the clip is disengaged from the garment.

In some instances, however, when there is a large number of cable and clip combinations on one rack of clothes, or when there is a high volume of potential customers examining the goods, and perhaps trying on the garment in some instances without removing the security clip, it is possible for the clip to inadvertently slip off of the garment. This may cause the customer to be embarrassed by the alarm which sounds, and in any event causes a disruption of the sales clerk's selling efforts. It would be of great advantage if the clip could be made more secure on the goods without causing apparent or real damage to the goods.

Accordingly, it is a primary object of the present invention to provide an electronic security clip device for garments such as jackets and coats and the like which allows for access to each individual item on the display rack or fixture without concern for inadvertent removal of the clip from the goods.

Another object of this invention is to provide a system in which individual cables are attached to garments at one end by a device which insures that the garment or other goods are secured to the security system to permit easy attachment and removal of the cable to the goods, but only upon authorized access to the device that is attached to the goods.

Yet another object of the present invention is to provide a security clip which provides a positive locking attachment to the goods that is resistant to efforts to disable the clip by tampering with the connection to the goods.

Other objects will appear hereinafter.

SUMMARY OF THE INVENTION

It has now been discovered that the above and other objects of the present invention may be accomplished in the following manner. Specifically, the present invention provides an electronic security clip device for use with an electronic security system having an alarm system.

Forming the essential elements of the device are a combination, including cable for attachment to the alarm system which terminates in a switch which provides an alarm signal when activated. The switch includes a biased probe which extends upward from the switch, such that the probe is adapted to be moved against a bias inward to a security position and outward by the bias to an alarm position. The switch is mounted in a clamp body having a base with a lower jaw mounted on the base. The lower jaw has an upwardly facing recess for positioning the switch with the probe extending up from the clamp body.

Also mounted on the clamp body is an upper jaw which pivots so that its downwardly facing upper jaw face engages the probe on the switch. The upper jaw face has a probe receiving socket for receiving the probe in the alarm position.

The present combination of elements for this invention also includes a locking means for positioning the upper and lower jaws in a normally closed position. In this manner, the upper jaw face engages the lower face such that placement of an object such as the sleeve of a shirt or the hem of a skirt between the upper jaw face and the lower jaw face prevents movement of the probe into the probe receiving socket to reach the alarm position. When the object is removed, the probe extends outward to the alarm position. When the probe reaches the alarm position it sends a signal to the alarm system.

The locking means of this invention is designed to prevent accidental opening of the jaws once the garment or other object has been placed between the jaws. If someone intentionally opens the device, the probe will be released to the alarm position, and security will be notified, unless the sales clerk deactivates the alarm at the control center, usually located at the other end of the cable.

One embodiment of this invention includes the use of a biasing means for positioning the upper jaw face of the clamp base on the lower face of the upper jaw in the normally closed position. This bias force is similar to the spring used in the above-identified commonly-owned application. In addition to the biasing means, this embodiment of this invention includes a collar means for locking the device in the normally closed position. The collar is slidably positioned over the clamp body for movement between an open position spaced from the upper jaw face and a closed position proximate the upper jaw face in the normally closed position.

The device of this embodiment also includes a trigger bar for locking the collar in the closed position. The trigger bar includes a sliding trigger bar movable in a slot in the clamp body between an unlocked position to a locked position. The trigger bar has an outwardly and downwardly extending tang for locking engagement with the collar upon movement of the collar to the normally closed position. This will function to prevent movement of the collar without movement of the trigger bar to the unlocked position.

Also included in this embodiment are a plurality of short longitudinally extending ridges of increasing height on the upper terminal face of the upper jaw, with the ridges progressing toward the collar in the closed position so as to engage the collar when it is in the normally close position. Similarly, the clamp body includes a lower terminal face having a similar plurality of short longitudinally extending ridges of increasing height progressing toward the collar in the closed position for similar engagement with the collar in the normally closed position.

A second embodiment of the present invention includes a different locking means or device. This embodiment includes a locking arm mounted on the upper jaw and extending backward out over the clamp body. The locking arm has a cam follower extending down toward the clamp body. A cam surface is rotatingly positioned on the clamp body for presenting a cam surface to engage the cam follower. The cam surface has an upper locus for urging the upper jaw into the normally closed position and a lower locus for urging the upper jaw into the open position. In a preferred embodiment, the cam surface is defined by a plurality of equally spaced, circumferentially extending spherically headed pins of varying and increasing heights such that the cam follower snaps into a desired position between pin heads.

It is preferred for this embodiment that the cam surface be rotatable from the lower locus to the upper locus in both clockwise and counterclockwise directions. It is desirable also to include a locking means on the clamp body for locking the cam surface in a desired position of rotation.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
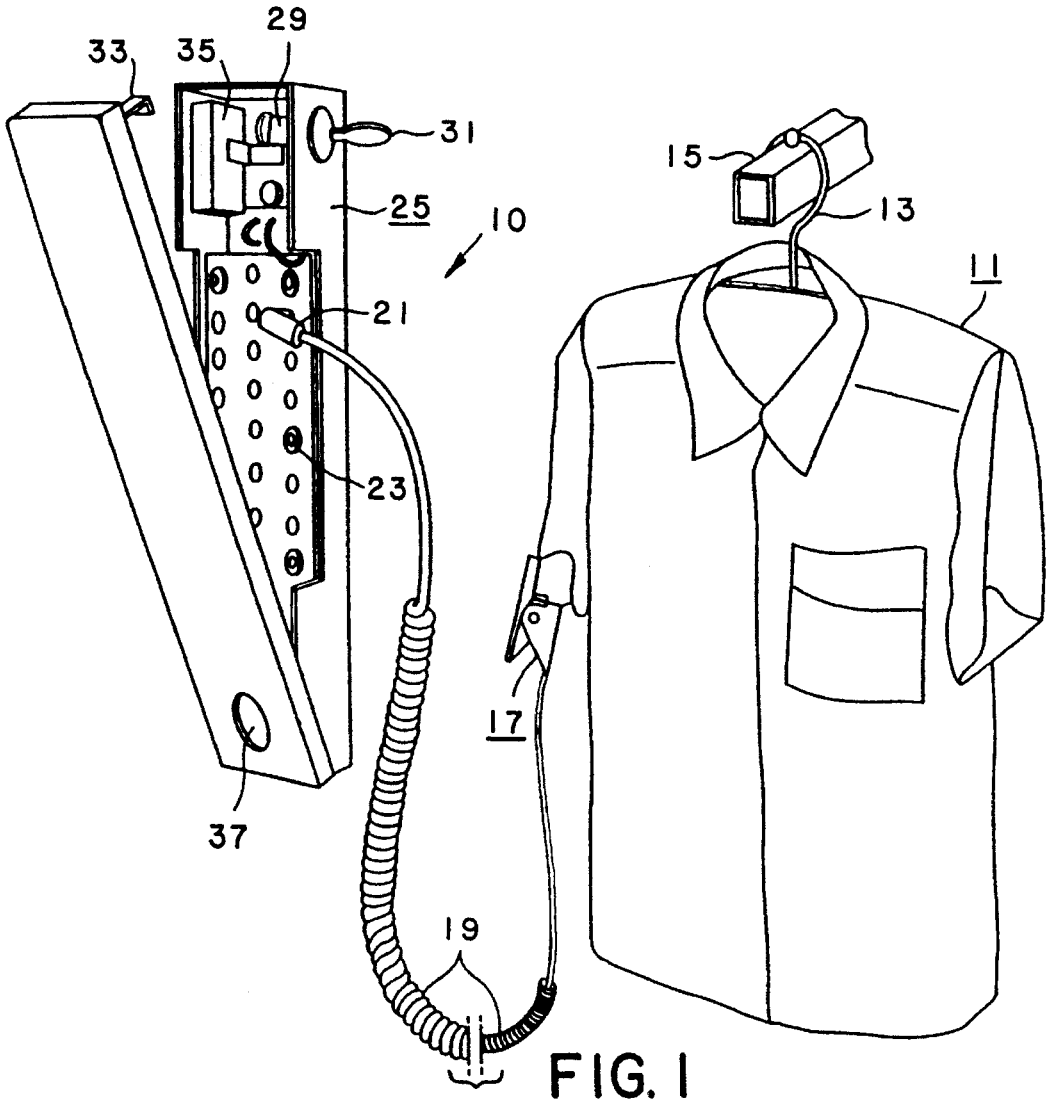
FIG. 1 is a pictorial view illustrating a security system in which the electronic security clip device of the present invention is employed.

It has now been discovered that the above and other objects of the present invention may be accomplished in the following manner. Specifically, the present invention provides an electronic security system security clip device for use with such security systems. The security system is suitable for many goods but is shown herein for use with garments and the like which are mounted for display on a display fixture.

The electronic alarm box includes a plurality of cable receiving jacks for receiving cables from individual objects. The alarm box is adapted to sound an alarm upon receipt of an alarm signal. At least one cable having the electronic security clip device of this invention is attached at one end to the cable receiving jacks. The other end of the cable has a clip which is attached to an object on a display fixture.

The electronic security clip device of the present invention may be employed with other security systems, since it is capable of generating a signal if any attempt is made to take the clip from the object to which it is attached without disarming the alarm device. In its simplest form, the clip device includes a pair of opposing jaws which are pivotally mounted on the clip means in a normally closed position, such that the clip means positions the alarm in operable relationship with the jaws.

Included within the clip is a cable and alarm means including switch means for activating the alarm upon placement of an object between the jaws. Removal of the object then causes the switch to trigger the cable and alarm means to transmit the alarm signal to the alarm box, resulting in an alarm unless the alarm has been temporarily deactivated by a sales clerk or other authorized person.

As shown in the drawings, a security system, 10 generally is intended for use with a garment 11 which is hung on a hanger 13 held by a clothes rack 15 or other display fixtures. Of course, other objects and other display fixtures are equally suitable for use with the present invention, and the particular hanger and rack are merely illustrative.

The principle feature of the present invention includes the use of an electronic security clip device, shown generally in FIG. 1 as 17. Clip 17 is attached at one end to a cable 19, which in turn is plugged into an alarm box by insertion of molded plug end 21 into an internal jack 23 of alarm box 25. Alarm box 25 is preferably that shown in the U.S. Pat. No. 4,610,182, the disclosure of which is incorporated herein by reference. The alarm box, which may be mounted to any adjacent structure in a variety of ways, includes alarm circuitry and a plurality of internal jacks 23 which transmit a signal from cable 19 to the alarm. Plug ends 21 are safely secured in alarm box 25 by closing cover 27 of alarm box 25, and by then locking cover 27 by, for example, a locking system where lock 29 is turned by key 31 to engage locking tab 33. Key 31 also operates a switch 34 which is powered, for example, by a 9-volt battery 35. The system is designed to operate in an open circuit condition so that power is not constantly used by battery 35. An alarm is sounded via alarm speaker 37 as shown in FIG. 1.

As is noted in the above-mentioned U.S. Pat. No. 4,610,182, cable 19 contains a pair of conductive elements, such as are included in coaxial cable such as COLUMBIA FLEX FOAM 1359, manufactured by Columbia Electronic Cables of Pawtucket, R.I. Any attempt to cut or otherwise remove the cable causes completion of an electronic circuit which activates the alarm. Cable 19 is preferably a high memory coiled cable which permits the customer to examine the garment and have a relatively large amount of freedom to move and to view the garment in a mirror, for example, and yet the memory function pulls the coils tight when cable 19 is not in use to preserve space and avoid entanglement. In the preferred embodiment shown in FIG. 1, there is a 12" straight lead and 28" of coiled length providing up to 16' in total length.

Figure 2:
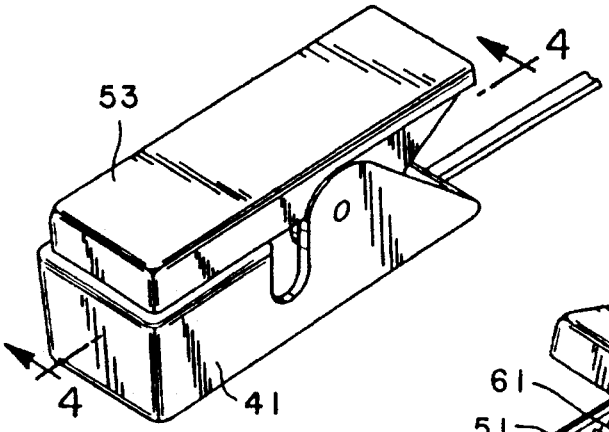
FIG. 2 is an enlarged isometric view showing the electronic security clip device of this invention in a closed or clamping mode.
Figure 3:
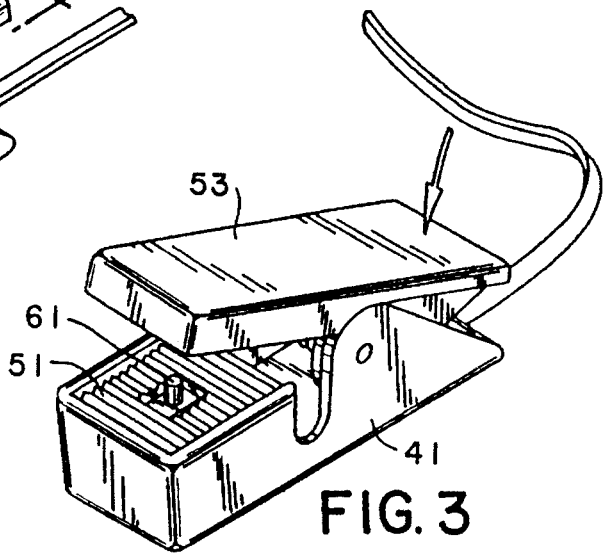
FIG. 3 is an isometric view similar to FIG. 2, but showing the device in an opened, unclamped mode.

Clip 17 in FIG. 1 is attached, as was described in greater detail in the above-identified co-pending application and in FIG. 3 by pressure on clip base 41 and upper jaw member 53 in the direction of the arrow shown in FIG. 3. Raising upper jaw 53 exposes probe 61, which is shown within upwardly facing recessed face 51 of lower jaw 82. FIG. 2 shows clip 17 in a closed or attached mode while FIG. 3 shows the open or detached mode.

Figure 4:
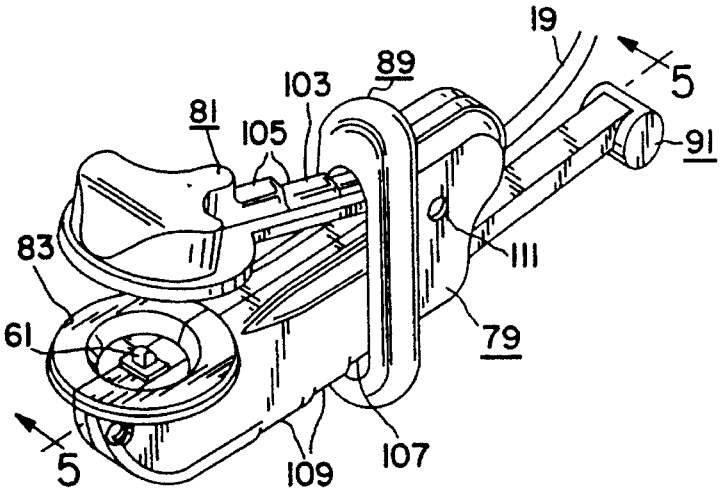
FIG. 4 is an isometric view illustrating one embodiment of the invention, in which the clamping device is shown in a fully opened position.
Figure 5:
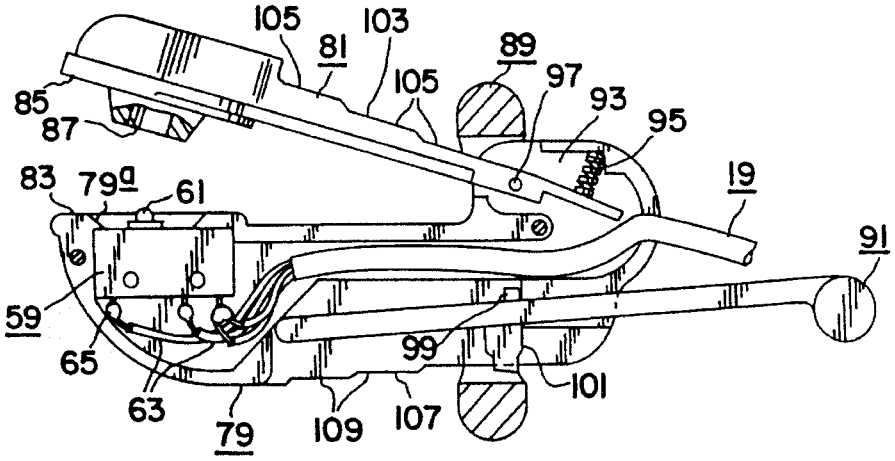
FIG. 5 is a slightly enlarged, sectional, elevational view taken on the line 5,5 of FIG. 4 showing one-half of the longitudinally divided body with its recessed areas for containing the pivotally-mounted, spring-biased, upper-clamping head and lever.
Figure 6:
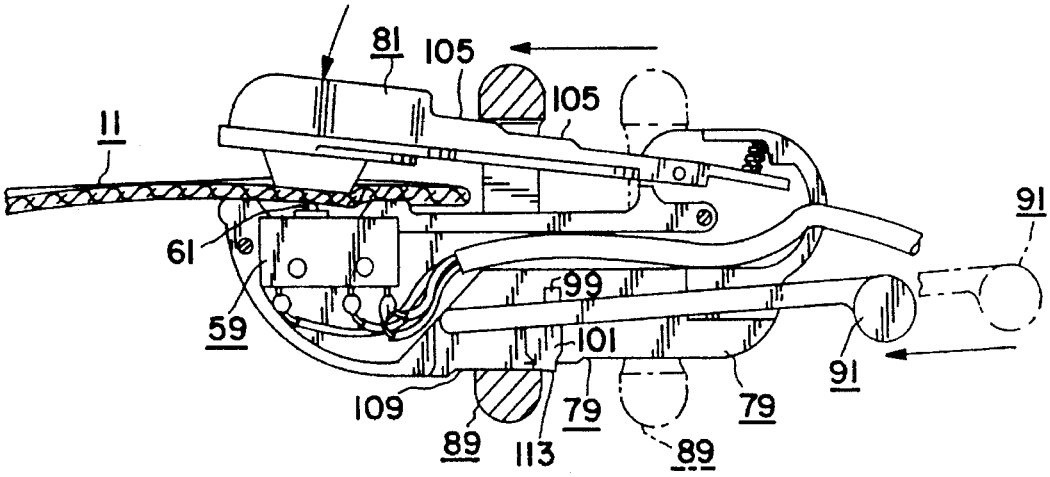
FIG. 6 is a view similar to FIG. 5 showing the device in a locked, clamping security mode.
Figure 8:
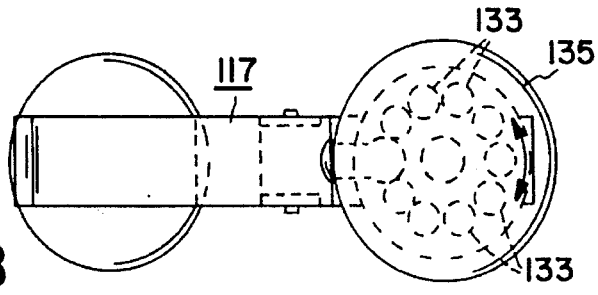
FIG. 8 is a plan view of the security clamp shown in FIG. 7.

One preferred embodiment of the present invention is shown in FIGS. 4, 5 and 6 in which a locking mechanism is used which prevents accidental removal of clip 17 from garment 11. A clamp body 79 pivotally supports an upper jaw 81 such that probe 61 extends from within upwardly facing recess 62 of upwardly extending face 83 of body 79. Upper jaw 81 includes a lower face 85 which includes a probe receiving socket 87. Of course, if clip 17 is inverted, the upward and downward directions are reversed, and no structural difference is intended by the descriptions of upper and lower facing and the like.

Also shown in FIGS. 4, 5 and 6 is micro switch 59 which is attached to cable 19. Micro switch 59 includes an upwardly extending, spring-biased probe 61 which operates switch 59 as will be described. Switch 59 is attached to cable 19 via leads 63 and solder junctions 65 or by other conventional electronic connections. Micro switch 59 is held by clamp body 79 which is sized to receive the switch. Cable 19 is properly protected and away from danger of being pinched during use of clip 17.

Upper jaw 81 includes a socket 87 in the downwardly directed lower face 85 for receiving probe 61 when the device is in the closed mode as shown in FIGS. 2 and 6. As long as switch probe 61 is extended from the body of micro switch 59, no alarm signal will be given, even when jaws 82, 81 are closed and probe 61 is in socket 87, as long as no force is applied to probe 61. When switch 59 is activated by depressing probe 61, such as when upper and lower jaws 81 and 82, respectively, are gripping a garment as shown in FIG. 6, probe 61 is forced into switch 59 and this activates switch 59. Now, when garment 11 is withdrawn either by pulling garment 11 from between upper jaw 81 and lower jaw 82 or by releasing the device to the open position of FIG. 5, probe 61 will be released and a signal will be sent by switch 59 to the appropriate alarm of the security system.

To insure that inadvertent sounding of the alarm does not occur, lower jaw 82 and upper jaw 81 are locked into place so that the garment 11 cannot be pulled from the device and jaws 82, 81 remain closed unless opened by a sales clerk after the alarm has been deactivated at the other end of cable 19 as previously described. The locking mechanism shown in this embodiment includes a collar 89 which is sized to fit securely on clamp body 79.

Collar 89 is shown in FIG. 4 in the fully retracted, inoperative position. Also retracted is trigger 91 which is used to lock the collar 89 in a clamping mode when desired. FIG. 5 is a slightly enlarged view of the device of FIG. 4, showing one-half of the longitudinally divided clamp body 79 with a recessed area 93 for containing the pivotally mounted upper jaw, spring 95 and pivot pin 97. The slidably actuated trigger 91 is positioned in its rearmost position with a limit stop lug 99 in contact with a should 67 formed in body 79.

As can be seen in FIG. 5, collar 89 does not engage tang 101 since the track for slidable trigger 91 has a generally downward slope in order to bring the tang 101 into engagement only when the collar 89 is in the fully locked position of FIG. 6. When this is done, tang 101 engages collar 89 on its slanted outer terminal surface 113 to wedge the collar 89 on one side while the other side of collar 89 engages lower jaw 82 and upper jaw 81 as described below.

As shown in FIG. 6, a garment 11 is placed between lower jaw 82 and upper jaw 81, after which upper jaw 81 is lowered so that the cone defining the socket 87 on lower face 85 engages the garment as probe 61 pushes into socket 87. The garment 11 depresses probe 61, thus activating switch 59. Collar 89 is moved forward to engage the upward face of upper jaw 81 on the downward face of clamp body 79. The upper jaw 81 includes an upper terminal face 103 having a plurality of short longitudinally extending ridges 105 of increasing height progressing toward the front or jaw end of the upper jaw 81 to engage the collar 89 when it is in a closed position. Similarly, clamp body 79 includes a lower terminal face 107 having a plurality of short longitudinally extending ridges 109 of increasing height progressing toward collar 89 in the normally closed position of FIG. 6. Ridges 105 and 109 may be formed as part of clamp body 79 and upper jaw 81 if clamp body 79 or upper jaw 81 is cast.

Collar 89 is of one piece construction and can be removed from the device only upon removal of the rear most assembly screw 111 that is one of the two screws that disassembles clamp body 79. Clamp body 79 is preferably cast in two mating parts, as shown, so that the switch 59 as attached to cable 19 can easily be inserted into its formed nesting place and upper jaw 81 can be attached on pivot pin 97 after installation of spring 95. Also, trigger 91 can be inserted into the cast slot with tang 101.

The operation of the clip device of the present invention is shown in FIGS. 4, 5 and 6 as follows. Prior to use, probe 61 is open and exposed because spring 95 keeps lower jaw 82 and upper jaw 81 apart. Pressure is then used to close upper jaw 81 onto the fabric of garment 11, as seen in FIG. 6. Fabric 11 causes probe 61 to be pushed into micro switch 59, thereby causing switch 59 to operate. As long as probe 61 remains in the alarm armed position shown in FIG. 6, garment 11 or other object is secure. If clip 17 is pressed to open jaws 82, 81, probe 61 will pop out of switch 59, thereby sending the alarm signal to the appropriate alarm box 25 or other part of the system as desired. Similarly, if a customer or other person attempts to slide fabric 11 out from between lower jaw 82 and upper jaw 81 without opening jaws 82, 81, the irregular face 85 of upper jaw 81 and lower jaw sloping portion **79*a* will resist such sliding movement. Nevertheless, if fabric 11 is removed, even without disturbing upper jaw 81, probe 61 will still pop up into socket 87** to then send the same alarm signal.

The only way an alarm signal can be prevented from sounding the alarm is to deactivate the alarm prior to removing clip 17. This is, of course, the intended purpose of the present invention, in that customers can try on a variety of garments at their leisure and in relative privacy without the sales clerk being directly present. The length of cable 19 allows for all the freedom that is needed for normal shopping. Nevertheless, an alarm will sound if cable 19 is cut or if clip 17 is removed from garment 11, thus insuring security protection for garment 11.

At the time when a particular garment 11 is selected, the sales clerk is called and garment 11 can be removed from the system. Specifically, the clerk deactivates the alarm, such as by turning key 31 to the off position, and then clip 17 can be depressed to open jaws 82, 81 and remove garment 11. The clerk then will close clip 17 and let it hang until additional inventory can be brought to the display fixture. As long as probe 61 fits into socket 87, probe 61 will not be pushed into switch 59 to activate the alarm and cause an alarm signal when probe 61 is released. Probe 61 is spring-biased to remain outside switch 59 absent additional force.

A further embodiment is shown in FIGS. 7, 8, 9, 10, and 11 using the same principles of this invention as does the first embodiment described above. In this embodiment, cable 19 is again attached to switch 59, mounted in the appropriate location in clip body 115, with probe 61 extending upward from switch 59 and toward upper jaw 117. Again upper jaw 117 includes a downward facing face 119 with a socket 121 for probe 61, all functioning as previously described. In this embodiment, a foam rubber surface 123 is shown on downward face 119 to further resist slidable movement of any objects such as fabric from between upper jaw 117 and lower jaw 141. Lower jaw 141 also has a plurality of circumferentially spaced, upwardly facing stub pins 124 for engagement with garment 11 such that surface 123 and pins 124 cooperatively hold garment 11 in place.

Figure 7:
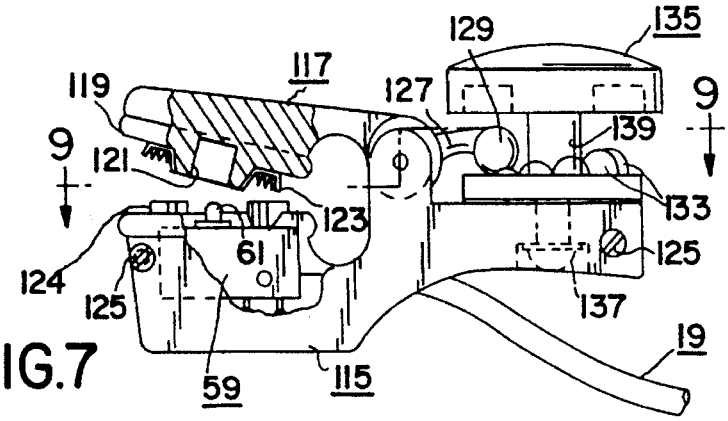
FIG. 7 is a slightly enlarged, side, elevational view of another embodiment of the invention, with a portion broken away and in section to show additional details.
Figure 9:
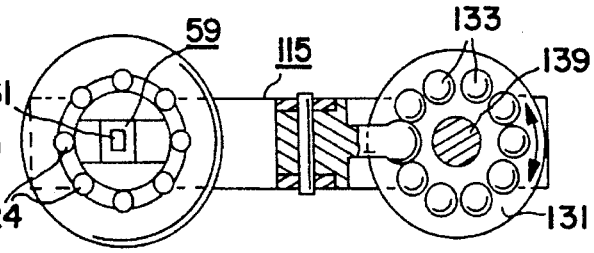
FIG. 9 is a sectional, plan view taken along the line 9,9 of FIG. 7.

Once again it is desirable to cast clip body 115 in two parts which may be fastened together with screws 125. Fixedly attached to upper jaw 117 is locking arm 127 which extends over clip body 115. Locking arm 127 includes a cam follower 129 extending toward clip body 115. A cam surface 131 is cooperatively positioned for rotation on clamp body 115 to present a cam surface for engaging cam follower 129. Cam surface 131 defines an upper locus for urging upper jaw 117 in the previously described normally closed position shown in FIG. 11 and a lower locus for urging upper jaw 117 in an open position, such as shown in FIG. 7.

Figure 10:
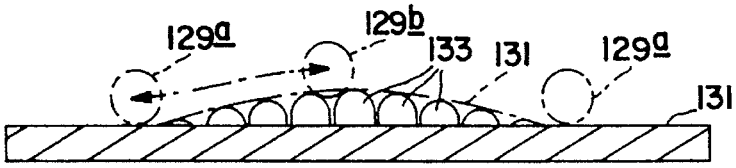
FIG. 10 is a schematic development of the cam surface produced by means of an equally spaced, circumferentially extending series of spherically headed pins of varying heights.
Figure 11:
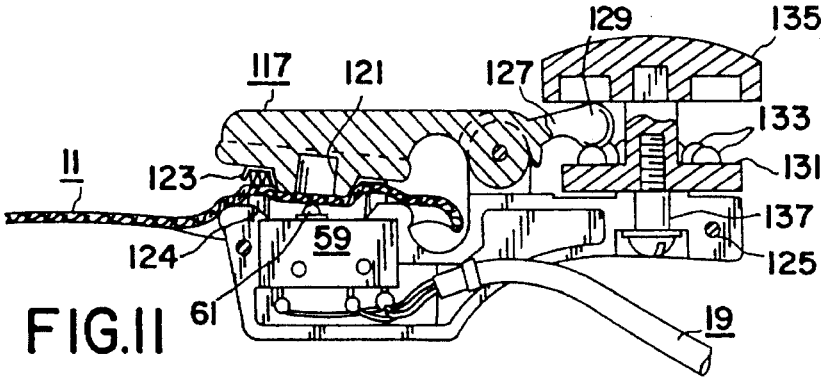
FIG. 11 is a sectional, elevational view showing the security clip of FIG. 7 in a clamping security mode.

Turning now to FIG. 10, it can be seen that cam surface 131 is defined by a plurality of equally spaced, circumferentially extending spherically headed pins 133 of varying heights such that cam follower 129 snaps into a desired position between pin heads 133. Shown in dot and dash lines is cam follower 129 of upper jaw 117 and the locus of movement from its lowest position **129*a* with the jaw 117 fully opened as in FIG. 7 to its highest position 129*b* with jaw 117 in its fully clamped down position as in FIG. 11. Preferably, the cam surface 131** is rotatable from its lower locus to its upper locus in both clockwise and counterclockwise directions.

Also provided in clip body 115 is a knob 135 keyed into center shaft 139 of cam surface 131. The shaft 139 extending up from cam surface 131 is keyed into knob 135 so that the particular desired locus of cam surface 131 can be presented to cam follower 129 merely by turning knob 135. Screw 137 also serves as a locking device for holding cam surface 131 in a desired position of rotation. Thus, garment 11 can be secured in the clip device of this embodiment and provide an alarm in the same manner as that for the first embodiment described above. In both cases, garment 11 is held between the lower jaw 118 and upper jaw 117 after the switch has been armed by depressing the outward extending probe 61. In both cases, any attempt to remove garment 11 without supervision by authorized personnel will result in an alarm being sounded. Also, in both case, garment 11 is held securely between jaws 117, 118 so that normal use and examination of garment 11 will not inadvertently cause the portion held by the device to escape, causing an unwanted alarm.

While particular embodiments of the present invention have been illustrated and described, it is not intended to limit the invention, except as defined by the following claims.

I claim:

1. An electronic security clip device for use with an electronic security system having an alarm system, comprising:

a cable for attachment to said alarm system and terminating in a switch means for providing an alarm signal, said switch means including a biased probe extending upward from said switch means, said probe being adapted to be moved against said bias inward to a security position and outward by said bias to an alarm position;

a clamp body having a base with a lower jaw mounted on said base and an upwardly facing recess on said lower jaw for positioning said switch means with said probe extending up from said clamp body;

an upper jaw pivotally mounted on said clamp body and having a downwardly facing upper jaw face, said upper jaw face having a probe receiving socket for receiving said probe in said alarm position; and locking means for positioning said upper and lower jaws in a normally closed position wherein said upper jaw face engages said lower jaw face such that placement of an object between said upper jaw face and said lower jaw face prevents movement of said probe into said probe receiving socket to reach said alarm position, whereby removal of said object causes said probe to reach said alarm position to signal said alarm system.

2. The device of claim 1, wherein said locking means comprises:

biasing means for positioning said upper jaw face on said lower jaw face in said normally closed position; and collar means for locking said upper jaw face in said normally closed position and slidably positioned over said clamp body for movement between an open position spaced from said upper jaw face and a closed position proximate said upper jaw face in said normally closed position.

3. The device of claim 2, which further includes trigger bar means for locking said collar means in said closed position, said trigger bar means including a moving mounted trigger bar for movement from an unlocked position to a locked position, said trigger bar having an outwardly extending tang for locking engagement with said collar means upon movement of said collar means to said normally closed position to prevent movement of said collar means without movement of said trigger bar to said unlocked position.

4. The device of claim 2, wherein said upper jaw includes an upper terminal face having a plurality of short longitudinally extending ridges of increasing height progressing toward said collar means in said closed position for engagement with said collar means in said normally closed position.

5. The device of claim 2, wherein said clamp body includes a lower terminal face having a plurality of short longitudinally extending ridges of increasing height progressing toward said collar means in said closed position for engagement with said collar means in said normally closed position.

6. The device of claim 5, wherein said upper jaw includes an upper terminal face having a plurality of short longitudinally extending ridges of increasing height progressing toward said collar means in said closed position for engagement with said collar means in said normally closed position.

7. The device of claim 1, wherein said locking means comprises:

a locking arm mounted on said upper jaw and extending over said clamp body, said locking arm having a cam follower extending toward said clamp body; and a cam surface rotatably positioned on said clamp body, said cam surface engaging said cam follower, said cam surface having an upper locus for urging said upper jaw into said normally closed position and a lower locus for urging said upper jaw into said open position.

8. The device of claim 7, wherein said cam surface is defined by a plurality of equally spaced, circumferentially extending spherically headed pins of varying heights such that said cam follower snaps into a desired position between said headed pins.

9. The device of claim 7, wherein said cam surface is rotatably mounted for rotation from said lower locus to said upper locus in both clockwise and counterclockwise directions.

10. The device of claim 7 wherein said locking means further comprises cam locking means for locking said cam surface in a desired position of rotation.

11. An electronic security clip device for use with an electronic security system having an alarm system, comprising:

a cable for attachment to said alarm system and terminating in a switch means for providing an alarm signal, said switch means including a biased probe extending upward from said switch means, said probe being adapted to be moved against said bias inward to a security position and outward by said bias to an alarm position;

a clamp body having a base with a lower jaw mounted on said base and an upwardly facing recess on said lower jaw for positioning said switch means with said probe extending up from said clamp body;

an upper jaw pivotally mounted on said clamp body and having a downwardly facing upper jaw face, said upper jaw face having a probe receiving socket for receiving said probe in said alarm position; and locking means for positioning said upper and lower jaws in a normally closed position wherein said upper jaw face engages said lower jaw face such that placement of an object between said upper jaw face and said lower jaw face prevents movement of said probe into said probe receiving socket to reach said alarm position, whereby removal of said object causes said probe to reach said alarm position to signal said alarm system; said locking means including biasing means for positioning said upper jaw face on said lower jaw face in said normally closed position and collar means for locking said upper jaw face in said normally closed position and slidably positioned over said clamp body for movement between an open position spaced from said upper jaw face and a closed position proximate said upper jaw face in said normally closed position;

said clamp body further including trigger bar means for locking said collar means in said closed position, said trigger bar means including a movably mounted trigger bar for movement from an unlocked position to a locked position, said trigger bar having an outwardly extending tang for locking engagement with said collar means upon movement of said collar means to said normally closed position to prevent movement of said collar means without movement of said trigger bar to said unlocked position;

said upper jaw including an upper terminal face having a plurality of short longitudinally extending ridges of increasing height progressing toward said collar means in said closed position for engagement with said collar means in said normally closed position and said clamp body including a lower terminal face having a plurality of short longitudinally extending ridges of increasing height progressing toward said collar means in said closed position for engagement with said collar means in said normally closed position.

12. An electronic security clip device for use with an electronic security system having an alarm system, comprising:

a cable for attachment to said alarm system and terminating in a switch means for providing an alarm signal, said switch means including a biased probe extending upward from said switch means, said probe being adapted to be moved against said bias inward to a security position and outward by said bias to an alarm position;

a clamp body having a base with a lower jaw mounted on said base and an upwardly facing recess on said lower jaw for positioning said switch means with said probe extending up from said clamp body;

an upper jaw pivotally mounted on said clamp body and having a downwardly facing upper jaw face, said upper jaw face having a probe receiving socket for receiving said probe in said alarm position; and locking means for positioning said upper and lower jaws in a normally closed position wherein said upper jaw face engages said lower jaw face such that placement of an object between said upper jaw face and said lower jaw face prevents movement of said probe into said probe receiving socket to reach said alarm position, whereby removal of said object causes said probe to reach said alarm position to signal said alarm system; said locking means including a locking arm mounted on said upper jaw and extending over said clamp body, said locking arm having a cam follower extending toward said clamp body, and a cam surface rotatably positioned on said clamp body, said cam surface engaging said cam follower, said cam surface having an upper locus for urging said upper jaw into said normally closed position and a lower locus for urging said upper jaw into said open position;

said cam surface defined by a plurality of equally spaced, circumferentially extending spherically headed pins of varying heights such that said cam follower snaps into a desired position between said headed pins;

said cam surface being rotatably mounted for rotation from said lower locus to said upper locus in both clockwise and counterclockwise directions, and a cam locking means on said clamp body for locking said cam surface in a desired position of rotation.

13. A method for attaching an electronic security clip device for use with an electronic security system having an alarm system, comprising the steps of:

attaching a cable to said alarm system and terminating in a switch means for providing an alarm signal, said switch means including a biased probe extending upward from said switch means, said probe being adapted to be moved against said bias inward to a security position and outward by said bias to an alarm position;

placing said probe in a clamp body having a base with a lower jaw mounted on said base and an upwardly facing recess on said lower jaw for positioning said switch means with said probe extending up from said clamp body and providing an upper jaw pivotally mounted on said clamp body and having a downwardly facing upper jaw face, said upper jaw face having a probe receiving socket for receiving said probe in said alarm position; and locking said upper and lower jaws in a normally closed position wherein said upper jaw face engages said lower jaw face such that placement of an object between said upper jaw face and said lower jaw face prevents movement of said probe into said probe receiving socket to reach said alarm position, whereby removal of said object causes said probe to reach said alarm position to signal said alarm system.

14. The method of claim 13, wherein said locking of upper and lower jaws comprises using a locking means which comprises:

biasing means for positioning said upper jaw face on said lower jaw face in said normally closed position; and collar means for locking said upper jaw face in said normally closed position and slidably positioned over said clamp body for movement between an open position spaced from said upper jaw face and a closed position proximate said upper jaw face in said normally closed position.

15. The method of claim 14, which further includes trigger bar means for locking said collar means in said closed position, said trigger bar means including a movably mounted trigger bar for movement from an unlocked position to a locked position, said trigger bar having an outwardly extending tang for locking engagement with said collar means upon movement of said collar means to said normally closed position to prevent movement of said collar means without movement of said trigger bar to said unlocked position.

16. The method of claim 14, wherein said upper jaw includes an upper terminal face having a plurality of short longitudinally extending ridges of increasing height progressing toward said collar means in said closed position for engagement with said collar means in said normally closed position.

17. The method of claim 14, wherein said clamp body includes a lower terminal face having a plurality of short longitudinally extending ridges of increasing height progressing toward said collar means in said closed position for engagement with said collar means in said normally closed position.

18. The method of claim 17, wherein said upper jaw includes an upper terminal face having a plurality of short longitudinally extending ridges of increasing height progressing toward said collar means in said closed position for engagement with said collar means in said normally closed position.

19. The method of claim 13, wherein said locking step is performed with a cam locking means comprising:

a locking arm mounted on said upper jaw and extending over said clamp body, said locking arm having a cam follower extending toward said clamp body; and a cam surface rotatably positioned on said clamp body, said cam surface engaging said cam follower, said surface having an upper locus for urging said upper jaw into said normally closed position and a lower locus for urging said upper jaw into said open position.

20. The method of claim 19, wherein said cam surface is defined by a plurality of equally spaced, circumferentially extending spherically headed pins of varying heights such that said cam follower snaps into a desired position between said headed pins.

21. The method of claim 19, wherein said cam surface is rotatably mounted for rotation from said lower locus to said upper locus in both clockwise and counterclockwise directions.

22. The method of claim 19 further comprising a cam locking means on said clamp body for locking said cam surface in a desired position of rotation.

* * * * *